US008344985B2

(12) United States Patent
Huang

(10) Patent No.: US 8,344,985 B2
(45) Date of Patent: Jan. 1, 2013

(54) LIQUID CRYSTAL DISPLAY WITH COMMON VOLTAGE COMPENSATION AND DRIVING METHOD THEREOF

(75) Inventor: Shun-Ming Huang, Shenzhen (CN)

(73) Assignees: Innocom Technology (Shenzhen) Co., Ltd., Shenzhen (CN); Chimei Innolux Corporation, Miaoli County (TW)

( * ) Notice: Subject to any disclaimer, the term of this patent is extended or adjusted under 35 U.S.C. 154(b) by 1255 days.

(21) Appl. No.: 12/152,101

(22) Filed: May 12, 2008

(65) Prior Publication Data

US 2008/0278471 A1 Nov. 13, 2008

(30) Foreign Application Priority Data

May 11, 2007 (TW) ..... 96116787 A

(51) Int. Cl.
*G09G 3/36* (2006.01)

(52) U.S. Cl. ..... 345/98; 345/89

(58) Field of Classification Search ..... 345/87, 345/89, 211
See application file for complete search history.

(56) References Cited

U.S. PATENT DOCUMENTS

| | | | | |
|---|---|---|---|---|
| 6,331,844 | B1 * | 12/2001 | Okumura et al. | 345/87 |
| 6,456,268 | B1 | 9/2002 | Takeda | |
| 2005/0169524 | A1 * | 8/2005 | Moriya | 382/167 |
| 2006/0072664 | A1 * | 4/2006 | Kwon et al. | 375/240.16 |
| 2006/0145995 | A1 * | 7/2006 | Kim et al. | 345/98 |
| 2006/0244704 | A1 | 11/2006 | Jae Hun | |
| 2007/0097054 | A1 * | 5/2007 | Cheng | 345/96 |
| 2007/0139344 | A1 * | 6/2007 | Zheng et al. | 345/98 |
| 2007/0164963 | A1 * | 7/2007 | Kim et al. | 345/98 |
| 2008/0024417 | A1 * | 1/2008 | Huang et al. | 345/98 |
| 2008/0117148 | A1 * | 5/2008 | Tu | 345/87 |
| 2008/0260268 | A1 | 10/2008 | Someya et al. | |

FOREIGN PATENT DOCUMENTS

| | | | |
|---|---|---|---|
| CN | 1854823 | A | 11/2006 |
| TW | 521244 | B | 2/2003 |
| TW | 094144824 | * | 12/2005 |
| TW | I253607 | B | 4/2006 |
| TW | I277037 | B1 * | 3/2007 |

* cited by examiner

*Primary Examiner* — Chanh Nguyen
*Assistant Examiner* — John Kirkpatrick
(74) *Attorney, Agent, or Firm* — WPAT PC; Justin King

(57) ABSTRACT

An exemplary liquid crystal display (300) includes a liquid crystal panel (301) having a plurality of pixel units (340), a data processor (391) having a calculation circuit (393) and an analyzing circuit (394), and a common voltage circuit (305). The calculation circuit is configured to carry out a predetermined calculation between display signals corresponding to a current frame period and display signals corresponding to a previous frame period. The analyzing circuit is configured to provide a compensating signal according to a result of the calculation. The common voltage circuit is configured to adjust a reference voltage signal according to the compensating signal, so as to generate a common voltage signal for the pixel units. A related method for driving a liquid crystal display is also provided.

19 Claims, 7 Drawing Sheets

LIQUID CRYSTAL DISPLAY WITH COMMON VOLTAGE COMPENSATION AND DRIVING METHOD THEREOF

FIELD OF THE INVENTION

The present invention relates to liquid crystal displays (LCDs), and more particularly to an LCD capable of compensating a common voltage signal thereof. The present invention also relates to a method for driving the LCD.

GENERAL BACKGROUND

LCDs are widely used in various information products, such as notebooks, personal digital assistants, video cameras, and the like.

FIG. 4 is essentially an abbreviated circuit diagram of a conventional LCD. The LCD 100 includes a liquid crystal panel 101, a scanning circuit 102, and a data circuit 103. The liquid crystal panel 101 includes n rows of parallel scanning lines 110 (where n is a natural number), m columns of parallel data lines 120 perpendicularly to the scanning lines 110 (where m is also a natural number), and a plurality of pixel units 140 cooperatively defined by the crossing scanning lines 110 and data lines 120. The scanning lines 110 are electrically coupled to the scanning circuit 102, and the data lines 120 are electrically coupled to the data circuit 130.

Each pixel unit 140 includes a thin film transistor (TFT) 141, a pixel electrode 142, and a common electrode 143. A gate electrode of the TFT 141 is electrically coupled to a corresponding one of the scanning lines 110, and a source electrode of the TFT 141 is electrically coupled to a corresponding one of the data lines 120. Further, a drain electrode of the TFT 141 is electrically coupled to the pixel electrode 142. The common electrodes 143 of all the pixel units 140 are electrically coupled together and further electrically coupled to a common voltage generating circuit (not shown). In each pixel unit 140, liquid crystal molecules (not shown) are disposed between the pixel electrode 142 and the common electrode 143, so as to cooperatively form a liquid crystal capacitor 147.

In operation, the common electrodes 143 receive a common voltage signal from the common voltage generating circuit. The scanning circuit 102 provides a plurality of scanning signals to the scanning lines 110 sequentially, so as to activate the pixel units 140 row by row. The data circuit 103 provides a plurality of data voltage signals to the pixel electrodes 142 of the activated pixel units 140. Thereby, the liquid crystal capacitors 147 of the activated pixel units 140 are charged. After the charging process, an electric field is generated between the pixel electrode 142 and the common electrode 143 in each pixel unit 140. The electric field drives the liquid crystal molecules to control light transmission of the pixel unit 140, such that the pixel unit 140 displays a particular color (red, green, or blue) having a corresponding gray level. The electric field is maintained by the liquid crystal capacitor 147 during a so-called current frame period, and accordingly the gray level of the color is maintained during the current frame period.

In the LCD 100, each pixel unit 140 employs a capacitor structure (i.e. the liquid crystal capacitor 147) to retain the gray level of the color. In addition, a plurality of parasitic capacitors usually exist in the pixel unit 140. Due to a so-called capacitor coupling effect, when the data voltage signal received by the pixel electrode 142 changes, an electrical potential of the common electrode 143 may be coupled and shift from the common voltage signal. Because the pixel units 140 are activated and receive the data voltage signals row by row, the electrical potentials of the common electrodes 143 of the activated row of pixel units 140 are liable to be pulled up or pulled down simultaneously and thereby have undesired values. Moreover, because the common electrodes 143 of the activated row of pixel units 140 are electrically coupled together, the undesired values of the electrical potentials are the same.

The shift of the electrical potential of the common electrode 143 may further bring on a change of the electric field between the pixel electrode 142 and the common electrode 143. Thereby, the gray level of the color displayed by the pixel unit 140 is apt to change, and accordingly a so-called color shift phenomenon may be generated. Thus the display quality of the LCD 100 may be somewhat unsatisfactory.

What is needed is to provide an LCD and a driving method thereof which can overcome the above-described deficiencies.

SUMMARY

In one aspect, a liquid crystal display includes a liquid crystal panel having a plurality of pixel units, a data processor having a calculation circuit and an analyzing circuit, and a common voltage circuit. The calculation circuit carries out a predetermined calculation between display signals corresponding to a current frame period and display signals corresponding to a previous frame period. The analyzing circuit provides a compensating signal according to a result of the calculation. The common voltage circuit adjusts a reference voltage signal according to the compensating signal, so as to generate a common voltage signal for the pixel units.

In another aspect, a method for driving a liquid crystal display includes: providing a liquid crystal panel having a plurality of pixel units; receiving display signals corresponding to the pixel units; providing a data processor having a calculation circuit and an analyzing circuit; carrying out a predetermined calculation between display signals corresponding to a current frame period and display signals corresponding to a previous frame period via the calculation circuit; generating a compensating signal according to a result of the calculation via the analyzing circuit; providing a common voltage circuit and a reference voltage signal; and adjusting a reference voltage signal according to the compensating signal via the common voltage circuit, and thereby generating a common voltage signal for the pixel units.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
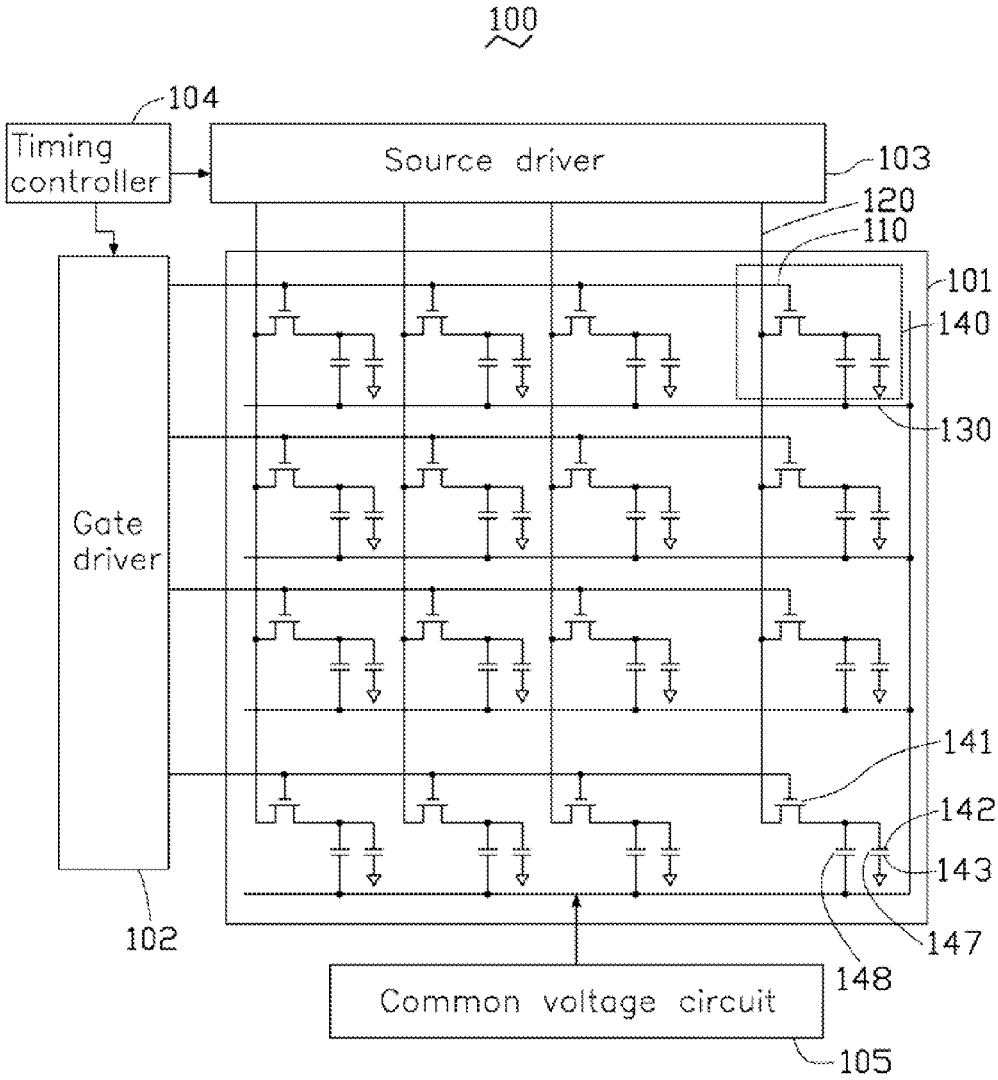
FIG. 1 is essentially an abbreviated circuit diagram of an LCD according to an exemplary embodiment of the present invention.

FIG. 1 is essentially an abbreviated circuit diagram of an LCD according to an exemplary embodiment of the present invention. The LCD 300 includes a liquid crystal panel 301, a scanning circuit 302, a data circuit 303, a timing controller 304, a common voltage circuit 305, and a memory 306.

The liquid crystal panel 301 includes n rows of parallel scanning lines 310 (where n is a natural number), n rows of parallel common lines 330 alternately arranged with the scanning lines 310, m columns of parallel data lines 320 perpendicular to the scanning lines 310 and the common lines 330 (where m is also a natural number), and a plurality of pixel units 340 cooperatively defined by the crossing scanning lines 310 and data lines 320. The scanning lines 310 are electrically coupled to the scanning circuit 302. The data lines 320 are electrically coupled to the data circuit 303. The common lines 330 are electrically coupled to the common voltage generating circuit 305. The pixel units 340 are arranged in a matrix.

Each pixel unit 340 includes a TFT 341, a pixel electrode 342, a common electrode 343, and a storage capacitor 348. A gate electrode of the TFT 341 is electrically coupled to a corresponding one of the scanning lines 310, and a source electrode of the TFT 341 is electrically coupled to a corresponding one of the data lines 320. Further, a drain electrode of the TFT 341 is electrically coupled to the pixel electrode 342. The common electrode 343 is opposite to the pixel electrode 342, with a plurality of the liquid crystal molecules (not shown) sandwiched therebetween, so as to cooperatively form a liquid crystal capacitor 347. One end of the storage capacitor 348 is electrically coupled to the pixel electrode 342, and the other end of the storage capacitor 348 is electrically coupled to a corresponding one of the common lines 330.

The timing controller 304 includes a receiving unit 307, a timing control unit 308, a data processor 391, and a look up table (LUT) 392. The receiving unit 307 is configured to receive display signals that are used for driving the pixel units 340. Each of the display signals corresponds to a respective pixel unit 340. In particular, each display signal is an 8-bit digital signal that corresponds to 256 gray levels. For example, if the 8-bit digital signal is 00000000, it corresponds to the first gray level indicating that a brightness of the corresponding color is lowest. If the 8-bit digital signal is 11111111, it corresponds to the 256th gray level indicating that a brightness of the corresponding color is greatest.

The timing control unit 308 is configured to control the driving timing of the scanning circuit 302 and the data circuit 303.

Figure 5:
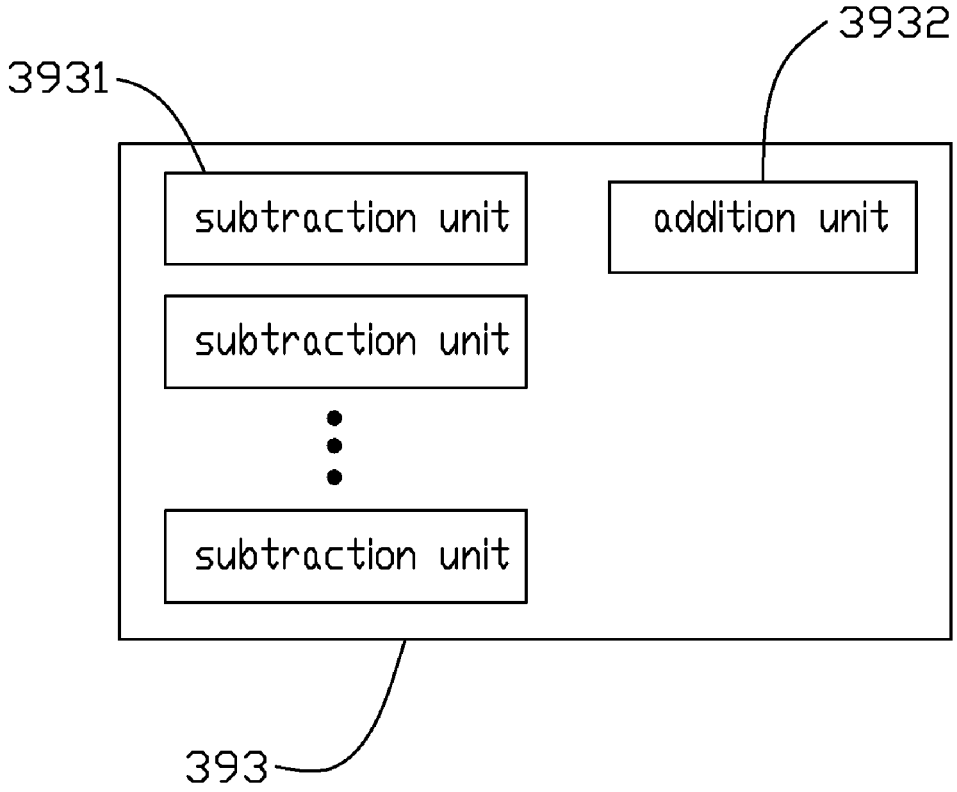
FIG. 5 is essentially an abbreviated block diagram of a calculation circuit of the LCD of FIG. 1, the calculation circuit including a plurality of subtraction units and an addition unit.

The data processor 391 includes a calculation circuit 393 and an analyzing circuit 394. The calculation circuit 393 is configured to carry out a predetermined calculation between display signals $D_N$ corresponding to a current frame period and display signals $D_{N-1}$ corresponding to a previous frame period. In particular, please referring to FIG. 5, the calculation circuit 393 includes a plurality of subtraction units 3931 configured for carrying out subtracting calculation, and an addition unit 3932 configured for carrying out adding calculation. The analyzing circuit 394 is configured to provide a compensating signal $D_{cp}$ according to a compensating control signal $S_C$ provided by the LUT 392. The LUT 392 is configured for storing a plurality of compensating control signals $S_C$, each of which corresponds to a calculation result of the calculation circuit 393.

The common voltage circuit 305 includes a reference voltage generator 371 and a voltage adjusting circuit 372. The reference voltage generator 371 is configured to provide a reference voltage signal $V_{ref}$ to the voltage adjusting circuit 372. The voltage adjusting circuit 372 is configured for adjusting the reference voltage signal $V_{ref}$ according to the compensating signal $D_{CP}$, so as to provide a common voltage signal $V_{com}$ to the liquid crystal panel 301.

In typical operation, the pixel units 340 of the LCD 300 are driven row by row. To simplify the following description, only an operation of the Xth row of pixel units 340 (X=1, 2, . . . , n) of the LCD 300 is taken as an example. In addition, the following definitions are used. Nth frame display signals $D_N$ refer to the display signals corresponding to the Xth row of pixel units 340 in a current frame period. (N−1)th frame display signals $D_{N-1}$ refer to display signals corresponding to the Xth row of pixel units 340 in a previous frame period. A first display signal $D_{(X,Y)N}$ refers to the display signal corresponding the pixel unit 340 positioned in the Xth row and Yth column (Y=1, 2, . . . , m) in the current frame period. A second display signal $D_{(X,Y)(N-1)}$ refers to the display signal corresponding the pixel unit 340 positioned in the Xth row and the Yth column in the previous frame period.

Figure 2:
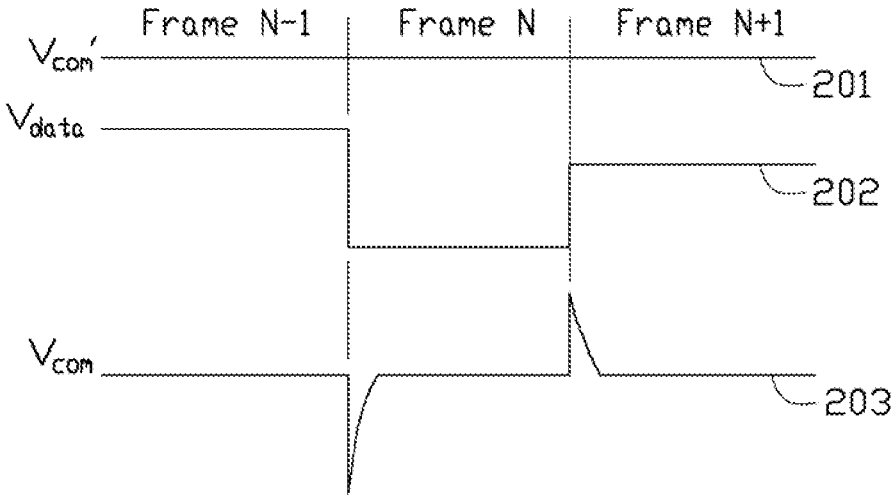
FIG. 2 is flow chart of an exemplary driving method for driving the LCD of FIG. 1, the driving method including steps S1~S9.

The LCD 300 can be driven via a driving method summarized in FIG. 2. The driving method includes: step S1, receiving and storing Nth frame display signals $D_N$; step S2, reading (N−1)th frame display signals $D_{N-1}$; step S3, comparing the Nth frame display signals $D_N$ with the (N−1)th frame display signals $D_{N-1}$ according to a predetermined calculation; step S4, generating a compensating control signal $S_C$ based on a result of the calculation; step S5, generating a compensating signal $D_{CP}$ based on the compensating control signal $S_C$; step S6, providing a reference voltage signal $V_{ref}$; step S7, adjusting the reference voltage signal $V_{ref}$ according to the compensating signal $D_{CP}$, so as to generate a common voltage signal $V_{com}$; step S8, providing a scanning signal and a plurality of data voltage signals; and step S9, driving the pixel units to display colors via cooperation of the scanning signal, the data voltage signals, and the common voltage signal $V_{com}$.

In step S1, the Nth frame display signals $D_N$ are received from an external circuit (not shown) by the receiving unit 307 of the timing controller 304. The Nth frame display signals $D_N$ are then stored in the memory 306, and are also outputted to the calculation circuit 393 of the data processor 391.

In step S2, the (N−1)th frame display signals $D_{N-1}$ are read from the memory 306 by the calculation circuit 393. The calculation circuit 393 distributes the Nth frame display signals $D_N$ and the (N−1)th frame display signals $D_{N-1}$ to the subtraction units 3931 thereof. In particular, each first display signal $D_{(X,Y)N}$ and a corresponding one of the second display signals $D_{(X,Y)(N-1)}$ are paired and distributed to a respective subtraction unit 3931.

Figure 3:
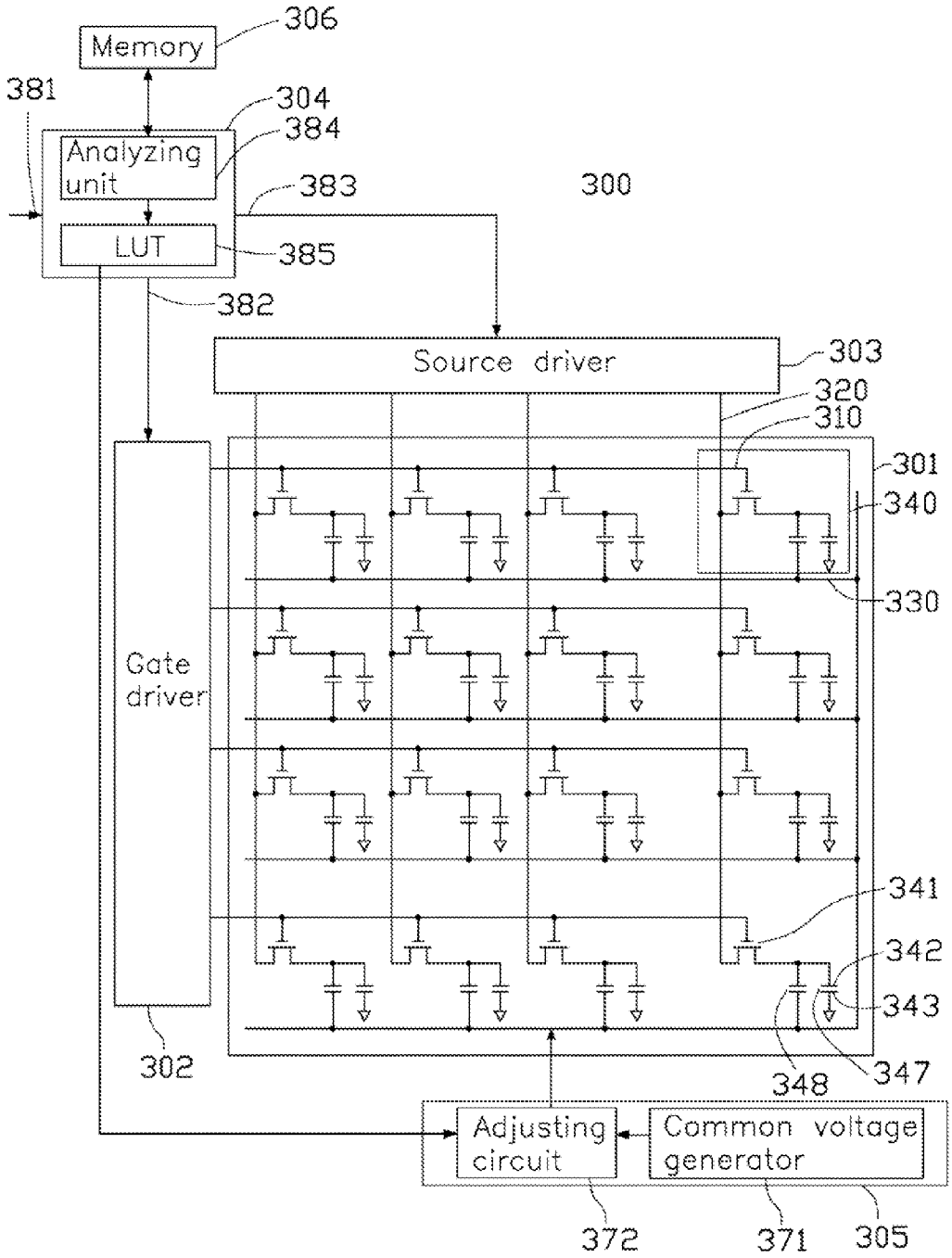
FIG. 3 is a flow chart of detailed processes of step S3 of the method of FIG. 2.
Figure 4:
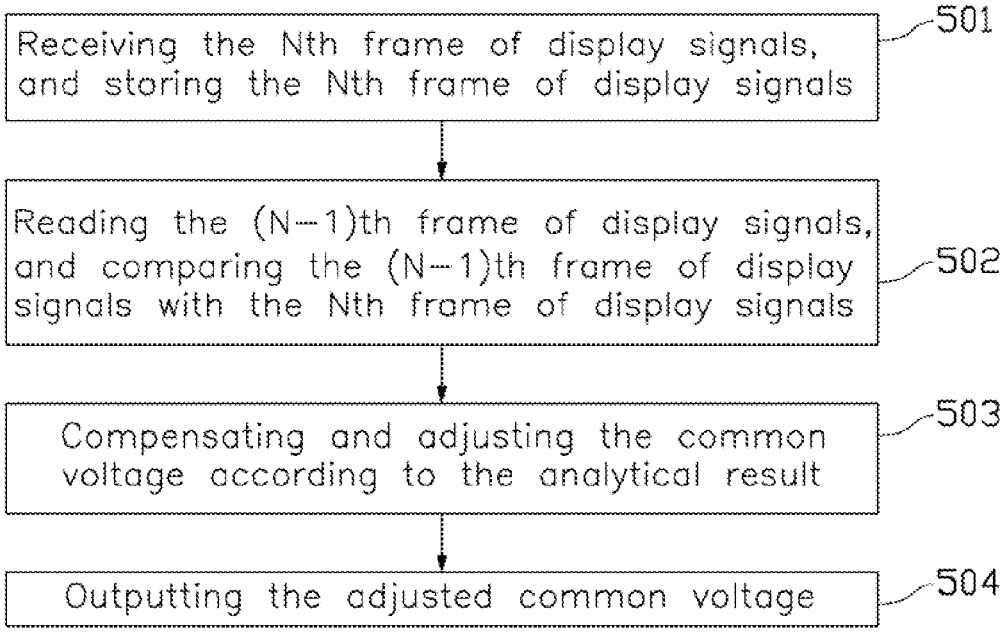
FIG. 4 is essentially an abbreviated circuit diagram of a conventional LCD.

In step S3, the Nth frame display signals $D_N$ and the (N−1)th frame display signals $D_{N-1}$ are compared via a predetermined calculation carried out by the calculation unit 391. Referring to FIG. 3, step S3 can for example include: sub-step S31, subtracting each of the second display signals $D_{(X,Y)(N-1)}$ from the corresponding one of the first display signals $D_{(X,Y)N}$, whereby a plurality of subtraction values $\Delta D_Y$ are obtained; and sub-step S32, adding all the subtraction values $\Delta D_Y$ together to obtain an accumulated value.

In detail, in sub-step S31, the subtracting calculation between each pair of the first and second display signal $D_{(X,Y)N}$, $D_{(X,Y)(N-1)}$ is carried out by the corresponding subtraction unit 3931. In sub-step S32, all the subtraction result values $\Delta D_Y$ are received by the addition unit 3932, and then are added together therein. Accordingly, an accumulated value is obtained in the addition unit 3932, and serves as the calculation result R of the calculation unit 391. The calculation in step S3 can be summarized as the following equation:

$$R = \sum_Y \Delta D_Y = \sum_Y (D_{(X,Y)N} - D_{(X,Y)(N-1)}).$$

Figure 6:
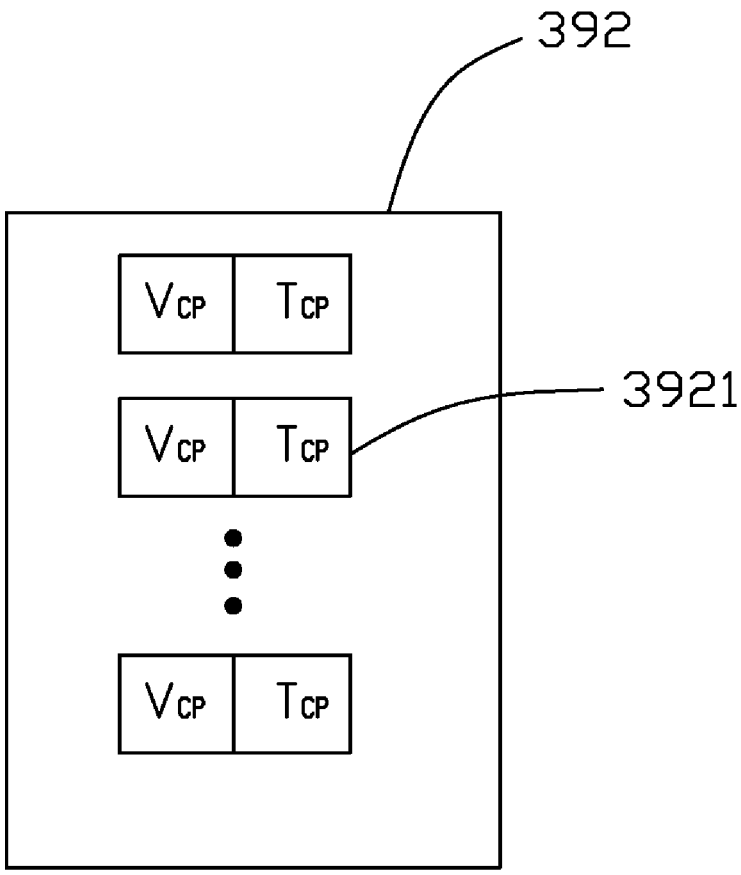
FIG. 6 is essentially an abbreviated circuit block diagram of a look up table of the LCD of FIG. 1, the look up table including a plurality of codes each including information of a compensating time period $T_{CP}$ and a compensating voltage value $V_{CP}$.

In step S4, the compensating control signal $S_C$ is read by the data processor 391 from the LUT 392 according to the calculation result R. The compensating control signal $S_C$ is transmitted to the analyzing unit 394. In particular, please referring to FIG. 6, the compensating control signal $S_C$ is stored in a form of a binary code 3921, which indicates information of a compensating time period $T_{CP}$ and a compensating voltage value $V_{CP}$.

Figure 7:
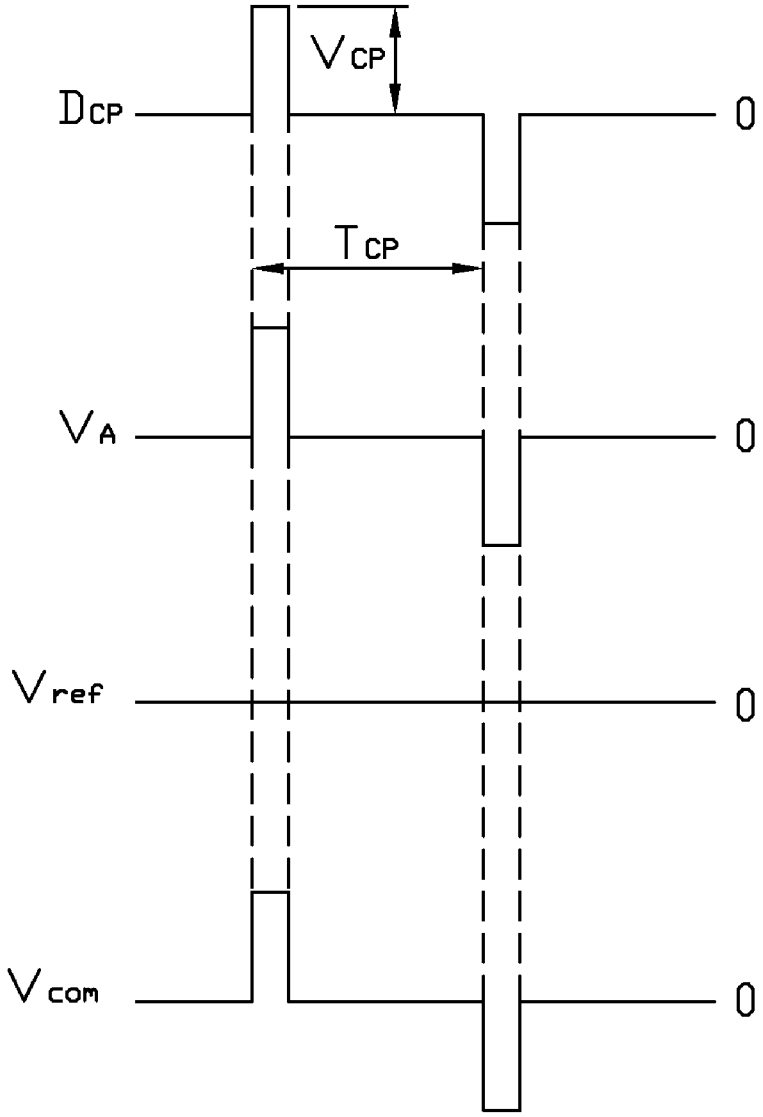
FIG. 7 is a timing chart of pulse signals transmitting in the LCD of FIG. 1.

In step S5, please referring to FIG. 7, the compensating control signal $S_C$ is decoded by the analyzing unit 394, and thereby the compensating time period $T_{CP}$ and the compensating voltage value $V_{CP}$ are obtained. The compensating time period $T_{CP}$ and the compensating voltage value $V_{CP}$ cooperatively form a compensating signal $D_{CP}$. A polarity of the compensating voltage value $V_{CP}$ is determined by a polarity of the calculation result R. In particular, the compensating voltage value $V_{CP}$ is positive when the calculation result R is negative, and the compensating voltage value $V_{CP}$ is negative when the calculation result R is positive. An absolute value of the compensating determined by the calculation result R. The compensating signal $D_{CP}$ is then outputted to the voltage adjusting circuit 372 of the common voltage circuit 305.

In step S6, the reference voltage signal $V_{ref}$ is provided by the reference voltage generator 371 of the common voltage circuit 305, and then outputted to the voltage adjusting circuit 372.

In step S7, firstly, the voltage adjusting circuit 372 generates an adjusting signal $V_A$ according to the compensating signal $D_{CP}$. The adjusting signal $V_A$ can for example be a pulse signal. In particular, please also referring to FIG. 7, a voltage amplitude of the pulse signal is the same as the compensating voltage value $V_{CP}$, and a pulse width of the pulse signal is the same as the compensating time period $T_{CP}$.

Secondly, the reference voltage signal $V_{ref}$ is adjusted by superposing it with the adjusting signal $V_A$. In the adjustment of the reference voltage signal $V_{ref}$, please also referring to FIG. 7, if the compensating voltage value $V_{CP}$ is positive, the reference voltage signal $V_{ref}$ is pulled up during the compensating time period $T_{CP}$. If the compensating voltage value $V_{CP}$ is negative, the reference voltage signal $V_{ref}$ is pulled down during the compensating time period $T_{CP}$. After the adjustment of the reference voltage signal $V_{ref}$, an adjusted voltage signal is generated. The adjusted voltage signal serves as the common voltage signal $V_{com}$, and is outputted to the common lines 330 and the common electrodes 343.

In step S8, the scanning signals and the data voltage signals are respectively provided by the scanning circuit 302 and the data circuit 303. In detail, the scanning circuit 302 receives a timing control signal from the timing control unit 304, and accordingly generates a plurality of scanning signals, one of which is used to activate the Xth row of pixel units 340. The data circuit 303 receives the Nth frame display signals $D_N$ and the polarity control signals from the timing control unit 304, and accordingly generates a plurality of data voltage signals corresponding to the Xth row of pixel units 340.

In step S9, the scanning circuit 302 outputs a corresponding one of the scanning signals to the Xth scanning line 310, so as to activate the Xth row of pixel units 340 via switching the corresponding TFTs 341 on. The data circuit 303 outputs the data voltage signals to the activated pixel units 340 respectively via the data lines 320 and the corresponding TFTs 341. Thereby, the liquid crystal capacitors 347 in the activated row of pixel units 340 are charged. An electric field is generated between the pixel electrode 342 and the common electrode 343 in each pixel unit 340 after the charging process. The electric field drives the liquid crystal molecules of the pixel unit 340 to control the light transmission of the pixel unit 340, such that the pixel unit 340 displays a particular color (e.g., red, green, or blue) having a corresponding gray level.

After that, the following rows of pixel units 340 are activated and driven to display corresponding colors sequentially during the Nth frame period, and the driving process for each row is similar to that for the above-described Xth row of pixel units 340. The aggregation of colors displayed by all the pixel units 340 of the LCD 300 simultaneously constitutes an image viewed by a user of the LCD 300.

In the LCD 300, the data processor 391 and the LUT 392 are employed to provide a compensating signal $D_{CP}$, and the voltage adjusting circuit 372 are employed to adjust the reference voltage signal $V_{ref}$ according to the compensating signal $D_{CP}$, so as to compensate the common voltage signal $V_{com}$ that might otherwise be coupled and shift due to a capacitor coupling effect. Thus the electric field between the pixel electrode 342 and the common electrode 343 of each pixel unit 340 is stable during the current frame period. Accordingly, the gray level of the color displayed by the pixel unit 340 is also stable. Therefore any color shift phenomenon that might otherwise be induced because of the capacitor coupling effect is diminished or even eliminated, and the display quality of the LCD 300 is improved.

In alternative embodiments, the predetermined calculation can be carried out via software pre-programmed in the data processor 385. The memory 306 can further be integrated into the timing controller 304.

It is to be further understood that even though numerous characteristics and advantages of preferred and exemplary embodiments have been set out in the foregoing description, together with details of structures and functions associated with the embodiments, the disclosure is illustrative only, and changes may be made in detail (including in matters of arrangement of parts) within the principles of the invention to the full extent indicated by the broad general meaning of the terms in which the appended claims are expressed.

What is claimed is:

1. A liquid crystal display, comprising:

a liquid crystal panel comprising a plurality of pixel units;

a timing controller configured to receive display signals from an external circuit to drive the pixel units;

a data processor comprising a calculation circuit and an analyzing circuit; and a common voltage circuit;

wherein the calculation circuit is configured to carry out a predetermined calculation between display signals corresponding to the pixel units in a current frame period and display signals corresponding to the pixel units in a previous frame period, the analyzing circuit is configured to provide a compensating signal according to a result of the calculation, and the common voltage circuit is configured to adjust a reference voltage signal according to the compensating signal so as to generate a common voltage signal for the pixel units; and wherein the calculation circuit further comprises a plurality of subtraction units, each of the subtraction units is configured to carry out a subtracting calculation between a first display signal corresponding to one of the pixel units in the current frame period and a second display signal corresponding to said pixel unit in the previous frame period.

2. The liquid crystal display of claim 1, further comprising a look up table configured for storing a plurality of compensating control signals, each of the compensating control signals corresponding to a calculation result.

3. The liquid crystal display of claim 2, wherein the compensating control signal is a code that indicates a compensating time period and a compensating voltage value.

4. The liquid crystal display of claim 3, wherein the analyzing circuit generates the compensating signal by decoding a selected one of the compensating control signals to obtain a corresponding compensating time period and a corresponding compensating voltage value.

5. The liquid crystal display of claim 4, wherein the common voltage circuit comprises a voltage adjusting circuit, the voltage adjusting circuit generates an adjusting signal according to the compensating signal, and adjusts the reference voltage signal by superposing the reference voltage signal with the adjusting signal.

6. The liquid crystal display of claim 5, wherein the adjusting signal is a pulse signal having a voltage amplitude the same as the compensating voltage value, and a pulse width the same as the compensating time period.

7. The liquid crystal display of claim 1, wherein the calculation circuit further comprises an addition unit, the addition unit is configured to add subtraction results obtained by the subtraction units together.

8. The liquid crystal display of claim 1, further comprising a memory, the memory is configured to store display signals corresponding to the pixel units in the previous frame period.

9. A method for driving a liquid crystal display, the method comprising:

providing a liquid crystal panel having a plurality of pixel units;

providing a timing controller;

receiving display signals from an external circuit to drive the pixel units via the timing controller;

providing a data processor including a calculation circuit and an analyzing circuit;

carrying out a predetermined calculation between display signals corresponding to the pixel units in a current frame period and display signals corresponding to the pixel units in a previous frame period via the calculation circuit, wherein the predetermined calculation comprises subtracting a first display signal corresponding to one of the pixel units in the previous frame period from a second display signal corresponding said pixel unit in the current frame period, and adding results of the subtractions together to obtain a calculation result;

generating a compensating signal according to a result of the calculation via the analyzing circuit;

providing a common voltage circuit and a reference voltage signal; and adjusting the reference voltage signal according to the compensating signal via the common voltage circuit, and thereby generating a common voltage signal for the pixel units.

10. The method of claim 9, further comprising: providing a look up table having a plurality of compensating control signals stored therein; and selecting a corresponding compensating control signal from the look up table according to the result of the calculation.

11. The method of claim 10, wherein each of the compensating control signals is a code that indicates a compensating time period and a compensating voltage value.

12. The method of claim 11, wherein an absolute value and a polarity of the compensating voltage value are both determined by the result of the calculation.

13. The method of claim 10, wherein the compensating signal is generated via decoding the selected one of the compensating control signals by the analyzing circuit.

14. The method of claim 13, wherein the compensating signal is cooperatively formed by a corresponding compensating time period and a corresponding compensating voltage value.

15. The method of claim 14, wherein the adjustment of the reference voltage signal comprises: generating an adjusting signal according to the compensating signal, and superposing the reference voltage signal with the adjusting signal.

16. The method of claim 15, wherein the adjusting signal is a pulse signal having a voltage amplitude the same as the compensating voltage value, and a pulse width the same as the compensating time period.

17. The method of claim 16, wherein the reference voltage signal is pulled up during the compensating time period when the compensating voltage value is positive, and the reference voltage signal is pulled down during the compensating time period when the compensating voltage value is negative.

18. A liquid crystal display, comprising:

a liquid crystal panel comprising a plurality of pixel units;

a timing controller configured to receive display signals from an external circuit to drive the pixel units;

a data processor comprising a calculation circuit and an analyzing circuit;

a look up table; and a common voltage circuit, wherein the common voltage circuit comprises a voltage adjusting circuit, the voltage adjusting circuit generates an adjusting signal according to a compensating signal, adjusts a reference voltage signal by superposing the reference voltage signal with the adjusting signal, and the adjusting signal is a pulse signal having a voltage amplitude equal to a compensating voltage value, and a pulse width equal to a compensating time period;

wherein the calculation circuit is configured to carry out a predetermined calculation between display signals corresponding to the pixel units in a current frame period and display signals corresponding to the pixel units in a previous frame period, the analyzing circuit is configured to provide a compensating signal according to a result of the predetermined calculation, and the common voltage circuit is configured to adjust the reference voltage signal according to the compensating signal so as to generate a common voltage signal for the pixel units; and wherein the look up table is configured for storing a plurality of compensating control signals, each of the compensating control signals corresponding to one calculation result, each of the plurality of the compensating control signals is a code indicating the compensating time period and the compensating voltage value, the analyzing circuit generates the compensating signal by decoding a selected one of the compensating control signals to obtain a corresponding compensating time period and a corresponding compensating voltage value.

19. A method for driving a liquid crystal display, the method comprising:

providing a liquid crystal panel having a plurality of pixel units;

providing a timing controller;

receiving display signals from an external circuit to drive the pixel units via the timing controller;

providing a data processor including a calculation circuit and an analyzing circuit;

carrying out a predetermined calculation between display signals corresponding to the pixel units in a current frame period and display signals corresponding to the pixel units in a previous frame period via the calculation circuit, wherein the predetermined calculation on the display signals comprises subtracting a first display signal corresponding to one of the pixel units in the previous frame period from a second display signal corresponding to the pixel unit in the current frame period;

generating a compensating signal according to a result of the calculation via the analyzing circuit;

providing a common voltage circuit and a reference voltage signal;

adjusting the reference voltage signal according to the compensating signal via the common voltage circuit, and thereby generating a common voltage signal for the pixel units, wherein adjustment of the reference voltage signal comprises generating an adjusting signal according to the compensating signal, and superposing the reference voltage signal with the adjusting signal, and wherein the adjusting signal is a pulse signal having a voltage amplitude equal to a compensating voltage value, and a pulse width equal to a compensating time period;

providing a look up table having a plurality of compensating control signals stored therein, and selecting a corresponding compensating control signal from the look up table according to the result of the calculation; and generating the compensating signal via decoding the selected one of the compensating control signals by the analyzing circuit, wherein the compensating control signal is cooperatively formed with a corresponding compensating time period and a corresponding compensating voltage value.

* * * * *